US008073380B2

(12) United States Patent
Koli et al.

(10) Patent No.: US 8,073,380 B2
(45) Date of Patent: Dec. 6, 2011

(54) MEDIA CONTENT DELIVERY AND RECORDING OVER BROADCAST NETWORK

(75) Inventors: Ari Koli, Helsinki (FI); Ilkka Tiainen, Espoo (FI)

(73) Assignee: Nokia Corporation, Espoo (FI)

( * ) Notice: Subject to any disclaimer, the term of this patent is extended or adjusted under 35 U.S.C. 154(b) by 1000 days.

(21) Appl. No.: 11/320,879

(22) Filed: Dec. 30, 2005

(65) Prior Publication Data

US 2007/0155306 A1 Jul. 5, 2007

(51) Int. Cl.
*H04H 1/00* (2006.01)

(52) U.S. Cl. ..... 455/3.01; 455/3.03; 455/414.3; 455/419

(58) Field of Classification Search ..... 455/3.01, 455/3.02, 3.03, 3.04, 3.05, 3.06, 414.3, 418, 455/419, 452.1, 414.1, 414.4, 509, 515, 517; 725/34, 110; 705/51; 345/743, 748; 713/150; 709/203

See application file for complete search history.

(56) References Cited

U.S. PATENT DOCUMENTS

| | | | | |
|---|---|---|---|---|
| 6,463,469 | B1 | 10/2002 | Yavitz | |
| 6,473,792 | B1 | 10/2002 | Yavitz et al. | |
| 2002/0046407 | A1 * | 4/2002 | Franco | 725/110 |
| 2004/0267388 | A1 | 12/2004 | Perdon | |
| 2005/0025147 | A1 | 2/2005 | Hamada et al. | |
| 2005/0091683 | A1 * | 4/2005 | Sheynman et al. | 725/34 |
| 2006/0080316 | A1 * | 4/2006 | Gilmore et al. | 707/9 |
| 2006/0080439 | A1 * | 4/2006 | Chud et al. | 709/225 |
| 2007/0198414 | A1 * | 8/2007 | Derrenberger | 705/51 |

FOREIGN PATENT DOCUMENTS

| | | | |
|---|---|---|---|
| GB | 2 349 548 | A | 1/2000 |
| GB | 2407947 | A | 5/2005 |
| JP | 2002-319226 | | 10/2002 |
| WO | WO 2004/072946 | A1 | 8/2004 |
| WO | 2005104000 | A2 | 11/2005 |

OTHER PUBLICATIONS

PCT International Search Report, Jun. 8, 2007, 12 pages.
PCT International Search Report, Jun. 8, 2007, 12 pages.
http://www.tv-anytime.org/main.html; 1 pgs.; printed on Dec. 30, 2005.
hq://xml.coverpages.org/tvAnytime.html; 11 pgs.; printed on Dec. 30, 2005.
http://www.worlddab.org/eureka.aspx; 4 pgs; printed on Dec. 30, 2005.
http://www.visualradio.com/1,121,,,541.html; 1 pg.; printed on Dec. 30, 2005.
hq://www.radioandtelly.co.uk/visualradio.html; 2 pgs.; printed on Dec. 30, 2005.
European Office Action for corresponding EP Application No. 06831769.2-1224, Jun. 24, 2011, pp. 1-6.
European Office Action for corresponding EP Application No. 06831769.2-1224/1966916, May 24, 2011, pp. 1-3.

* cited by examiner

*Primary Examiner* — John J Lee
(74) *Attorney, Agent, or Firm* — Ditthavong Mori & Steiner, P.C.

(57) ABSTRACT

The present invention is a system for facilitating the selection and downloading of a digital multimedia program based on broadcast information. A single keystroke may trigger a series of events that result in an authorized copy of the desired digital media being saved on a user device. The desired program is wirelessly downloaded in an encrypted format, and after an accounting and billing process transpires, a decryption key is delivered in to the user device in a wireless message. The copy of the desired digital media is then decrypted, and is properly licensed, so that the user may enjoy listening to this media with minimal restrictions.

62 Claims, 11 Drawing Sheets

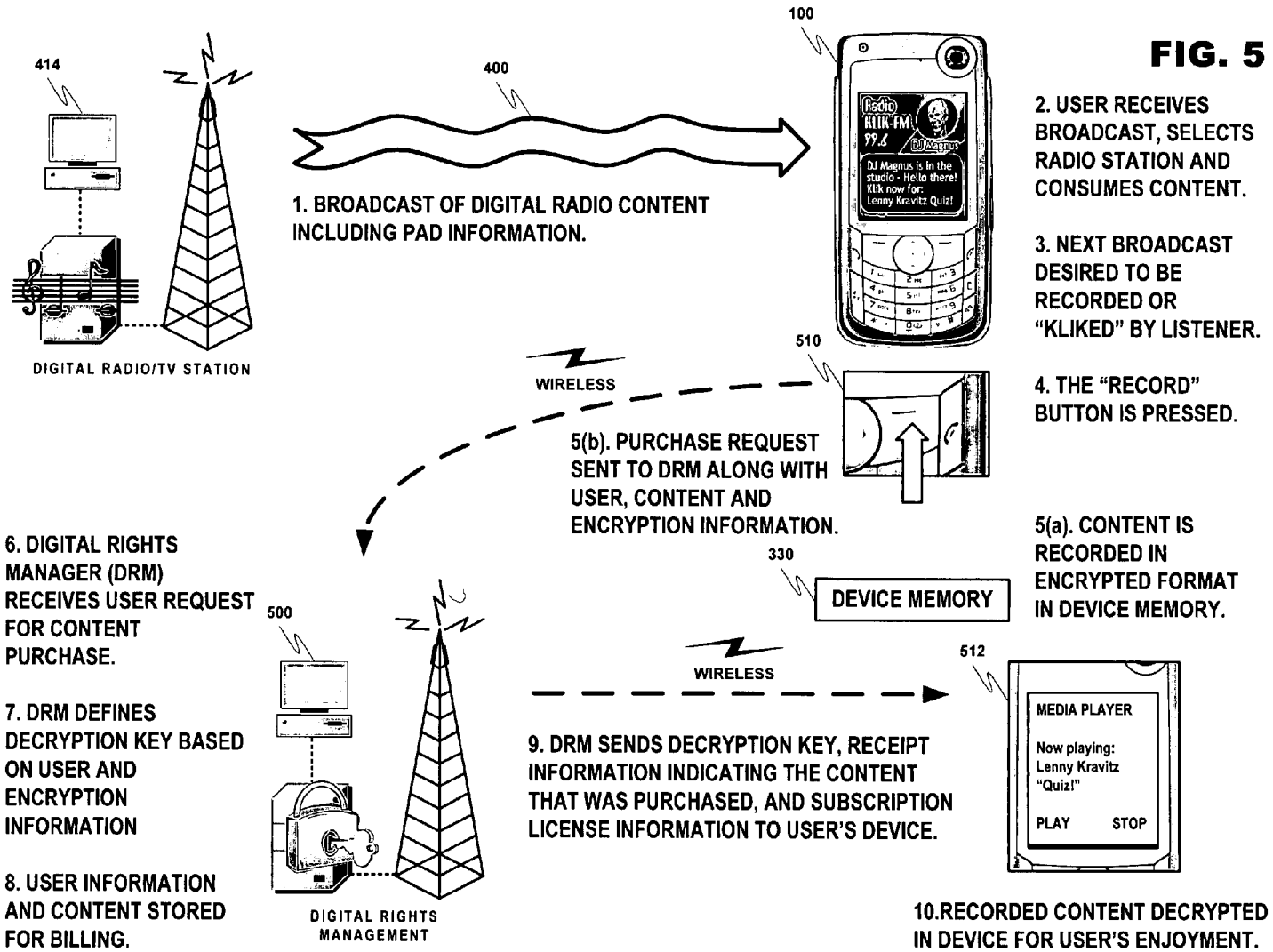
FIG. 5
1. BROADCAST OF DIGITAL RADIO CONTENT INCLUDING PAD INFORMATION.
2. USER RECEIVES BROADCAST, SELECTS RADIO STATION AND CONSUMES CONTENT.
3. NEXT BROADCAST DESIRED TO BE RECORDED OR "KLIKED" BY LISTENER.
4. THE "RECORD" BUTTON IS PRESSED.
5(a). CONTENT IS RECORDED IN ENCRYPTED FORMAT IN DEVICE MEMORY.
5(b). PURCHASE REQUEST SENT TO DRM ALONG WITH USER, CONTENT AND ENCRYPTION INFORMATION.
6. DIGITAL RIGHTS MANAGER (DRM) RECEIVES USER REQUEST FOR CONTENT PURCHASE.
7. DRM DEFINES DECRYPTION KEY BASED ON USER AND ENCRYPTION INFORMATION
8. USER INFORMATION AND CONTENT STORED FOR BILLING.
9. DRM SENDS DECRYPTION KEY, RECEIPT INFORMATION INDICATING THE CONTENT THAT WAS PURCHASED, AND SUBSCRIPTION LICENSE INFORMATION TO USER'S DEVICE.
10. RECORDED CONTENT DECRYPTED IN DEVICE FOR USER'S ENJOYMENT.
DIGITAL RADIO/TV STATION
DIGITAL RIGHTS MANAGEMENT
DEVICE MEMORY
WIRELESS
WIRELESS
MEDIA PLAYER
Now playing: Lenny Kravitz "Quiz!"
PLAY
STOP
100
400
414
500
510
512
330

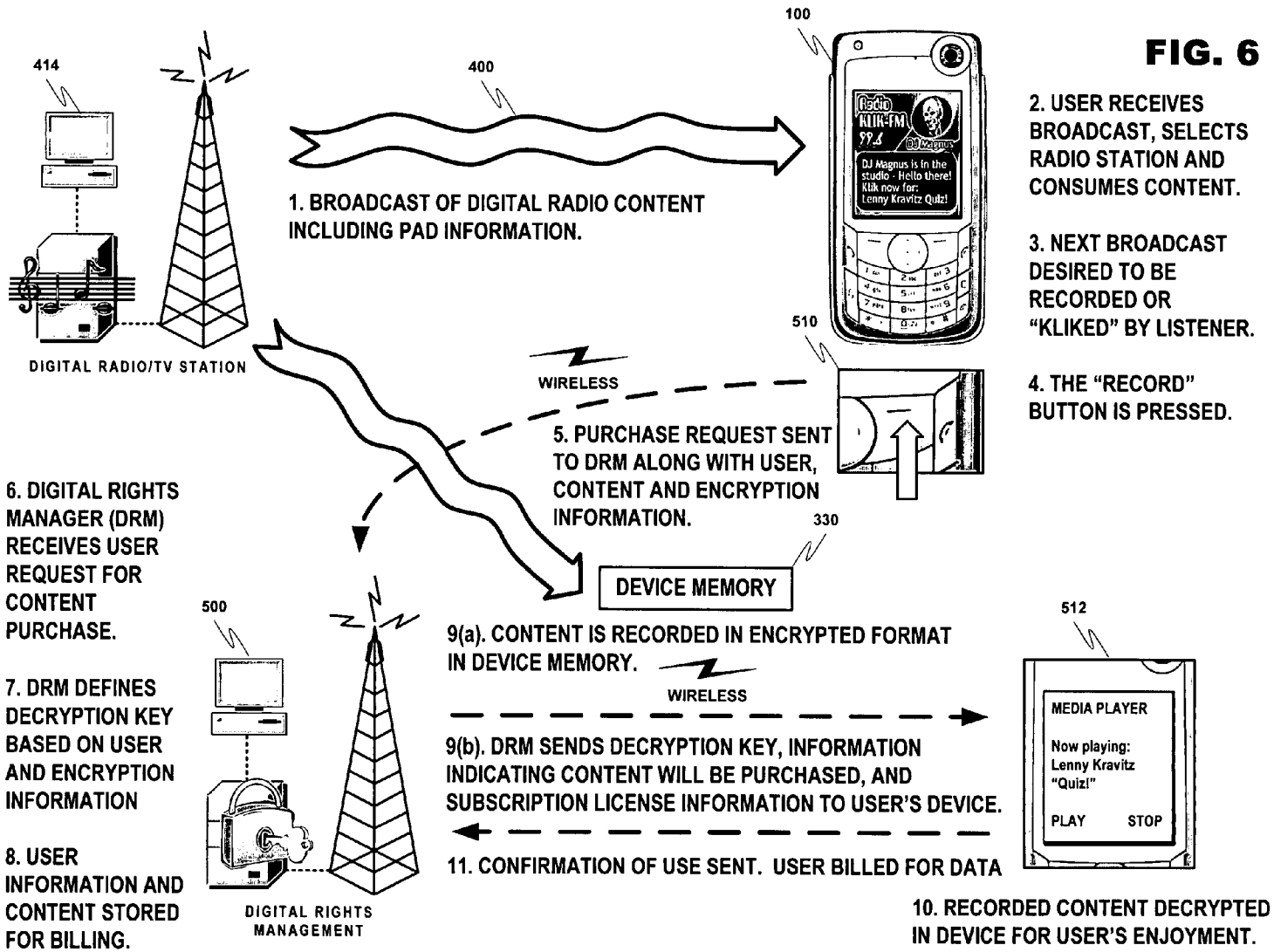
FIG. 6
2. USER RECEIVES BROADCAST, SELECTS RADIO STATION AND CONSUMES CONTENT.
3. NEXT BROADCAST DESIRED TO BE RECORDED OR "KLIKED" BY LISTENER.
4. THE "RECORD" BUTTON IS PRESSED.
100
510
512
MEDIA PLAYER
Now playing: Lenny Kravitz "Quiz!"
PLAY
STOP
DJ Magnus is in the studio - Hello there! Klik now for: Lenny Kravitz Quiz!
KLIK-FM
99.4
400
1. BROADCAST OF DIGITAL RADIO CONTENT INCLUDING PAD INFORMATION.
WIRELESS
5. PURCHASE REQUEST SENT TO DRM ALONG WITH USER, CONTENT AND ENCRYPTION INFORMATION.
330
DEVICE MEMORY
9(a). CONTENT IS RECORDED IN ENCRYPTED FORMAT IN DEVICE MEMORY.
WIRELESS
9(b). DRM SENDS DECRYPTION KEY, INFORMATION INDICATING CONTENT WILL BE PURCHASED, AND SUBSCRIPTION LICENSE INFORMATION TO USER'S DEVICE.
11. CONFIRMATION OF USE SENT. USER BILLED FOR DATA
10. RECORDED CONTENT DECRYPTED IN DEVICE FOR USER'S ENJOYMENT.
414
DIGITAL RADIO/TV STATION
6. DIGITAL RIGHTS MANAGER (DRM) RECEIVES USER REQUEST FOR CONTENT PURCHASE.
500
7. DRM DEFINES DECRYPTION KEY BASED ON USER AND ENCRYPTION INFORMATION
8. USER INFORMATION AND CONTENT STORED FOR BILLING.
DIGITAL RIGHTS MANAGEMENT

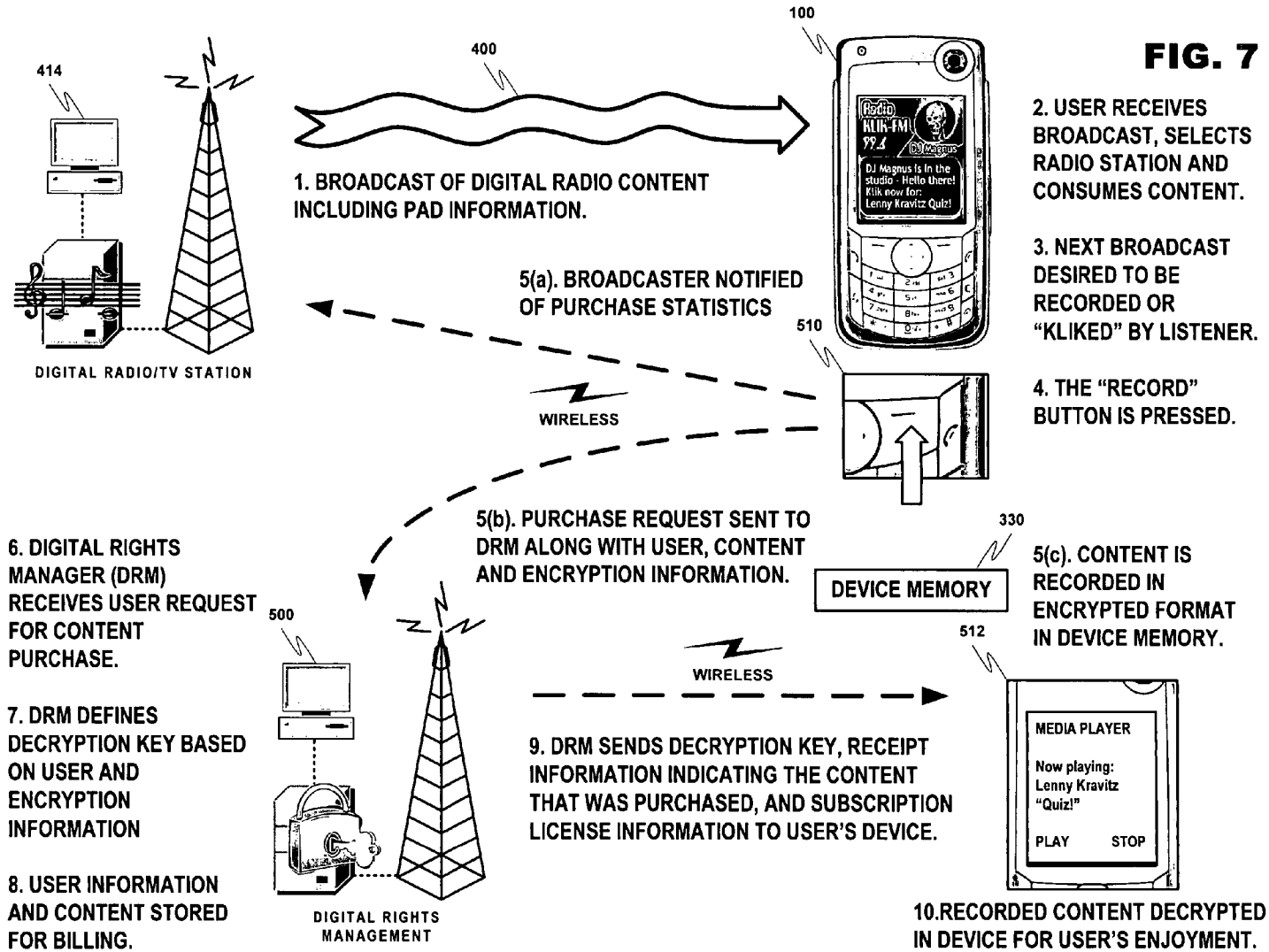
FIG. 7
1. BROADCAST OF DIGITAL RADIO CONTENT INCLUDING PAD INFORMATION.
2. USER RECEIVES BROADCAST, SELECTS RADIO STATION AND CONSUMES CONTENT.
3. NEXT BROADCAST DESIRED TO BE RECORDED OR "KLIKED" BY LISTENER.
4. THE "RECORD" BUTTON IS PRESSED.
5(a). BROADCASTER NOTIFIED OF PURCHASE STATISTICS
5(b). PURCHASE REQUEST SENT TO DRM ALONG WITH USER, CONTENT AND ENCRYPTION INFORMATION.
5(c). CONTENT IS RECORDED IN ENCRYPTED FORMAT IN DEVICE MEMORY.
6. DIGITAL RIGHTS MANAGER (DRM) RECEIVES USER REQUEST FOR CONTENT PURCHASE.
7. DRM DEFINES DECRYPTION KEY BASED ON USER AND ENCRYPTION INFORMATION
8. USER INFORMATION AND CONTENT STORED FOR BILLING.
9. DRM SENDS DECRYPTION KEY, RECEIPT INFORMATION INDICATING THE CONTENT THAT WAS PURCHASED, AND SUBSCRIPTION LICENSE INFORMATION TO USER'S DEVICE.
10.RECORDED CONTENT DECRYPTED IN DEVICE FOR USER'S ENJOYMENT.
DIGITAL RADIO/TV STATION
DIGITAL RIGHTS MANAGEMENT
DEVICE MEMORY
WIRELESS
WIRELESS
MEDIA PLAYER
Now playing:
Lenny Kravitz
"Quiz!"
PLAY
STOP
100
400
414
500
510
512
330

MEDIA CONTENT DELIVERY AND RECORDING OVER BROADCAST NETWORK

BACKGROUND OF THE INVENTION

1. Field of Invention

The present invention relates to a system for the wireless distribution of digital multimedia content, and more specifically, to an automated system for selecting, based on broadcast content, digital multimedia programs to be downloaded to a wireless communication device in accordance with any digital rights requirements that may be protecting the content.

2. Description of Prior Art

Modern society has quickly adopted, and become reliant upon, handheld devices for wireless communication. For example, cellular telephones continue to proliferate in the global marketplace due to technological improvements in both the quality of the communication and the functionality of the devices. These wireless communication devices (WCDs) have become commonplace for both personal and business use, allowing users to transmit and receive voice, text and graphical data from a multitude of geographic locations. The communication networks utilized by these devices span different frequencies and cover different broadcast distances, each having strengths desirable for various applications.

Cellular networks facilitate WCD communication over large geographic areas. These network technologies have commonly been divided by generations, starting in the late 1970s to early 1980s with first generation (1G) analog cellular telephones that provided baseline voice communications, to the now emerging 4G streaming digital video content planned for the 2006-2007 timeframe. GSM is an example of a widely employed 2G digital cellular network communicating in the 900 MHZ-1.8 GHZ band in Europe and at 1.9 GHZ in the United States. This network provides voice communication and also supports the transmission of textual data via the Short Messaging Service (SMS). SMS allows a WCD to transmit and receive text messages of up to 160 characters, while providing data transfer to packet networks, ISDN and POTS users at 9.6 Kbps. The Multimedia Messaging Service (MMS), an enhanced messaging system allowing for the transmission of sound, graphics and video files in addition to simple text, has also become available in certain devices. Soon emerging technologies such as Digital Video Broadcasting for Handheld Devices (DVB-H) will make streaming digital video, and other similar content, available via direct broadcast to a WCD. While long-range communication networks like GSM are a well-accepted means for transmitting and receiving data, due to cost, traffic and legislative concerns, these networks may not be appropriate for all data applications.

Short-range wireless networks provide communication solutions that avoid some of the problems seen in large cellular networks. Bluetooth™ is an example of a short-range wireless technology quickly gaining acceptance in the marketplace. A Bluetooth™ enabled WCD transmits and receives data at a rate of 720 Kbps within a range of 10 meters, and may transmit up to 100 meters with additional power boosting. A user does not actively instigate a Bluetooth™ network. Instead, a plurality of devices within operating range of each other will automatically form a network group called a "piconet". Any device may promote itself to the master of the piconet, allowing it to control data exchanges with up to seven "active" slaves and 255 "parked" slaves. Active slaves exchange data based on the clock timing of the master. Parked slaves monitor a beacon signal in order to stay synchronized with the master, and wait for an active slot to become available. These devices continually switch between various active communication and power saving modes in order to transmit data to other piconet members. In addition to Bluetooth™ other popular short-range wireless networks include WLAN (of which "Wi-Fi" local access points communicating in accordance with the IEEE 802.11 standard, is an example), WUSB, UWB, etc. All of these wireless mediums have features and advantages that make them appropriate for various applications.

More recently, manufacturers have also began to incorporate various resources for providing enhanced functionality in WCDs (e.g., components and software for performing close-proximity wireless information exchanges). Sensors and/or scanners may be used to read visual or electronic information into a device. A transaction may involve a user holding their WCD in proximity to a target, aiming their WCD at an object (e.g., to take a picture) or sweeping the device over a printed tag or document. Machine-readable technologies such as radio frequency identification (RFID), Infra-red (IR) communication, optical character recognition (OCR) and various other types of visual, electronic and magnetic scanning are used to quickly input desired information into the WCD without the need for manual entry by a user.

Wireless communication devices employing the previously discussed characteristics may be used for a variety of applications other than basic voice communications. Exemplary applications for business may include scheduling, word processing, spreadsheets, facsimile transmission, contact management, etc. There are also a multitude applications for the personal enjoyment of the user, such as games, instant messaging, display wallpaper, etc. In addition, some newer WCDs may include resources supporting the receipt of broadcast content from a variety of sources. Broadcast sources may include such technologies as standard analog radio broadcasting, "smart" analog radio including services such as Radio Data Service (RDS) or Visual Radio, Digital Audio Broadcasting (DAB) and Digital Video Broadcasting (DVB), such as DVB for Handheld Devices (DVB-H). A user may utilize services of this type to receive a streaming broadcast of audio and/or video content directly to their WCD. This content is often be accompanied by relevant information such as the name of the program, the artist or source of the program, program duration, etc. depending on the technology employed.

Similar to a standard radio broadcasting, information received via the aforementioned streaming services is only temporarily enjoyed by the user before the next program is sent. However, there may be some cases where a user wants to record information for playback at a later time. In the case of recording standard analog radio, while the recording of broadcast content might arguably be a breach of the content owners rights, the reproduction of analog information decays with each subsequent copy, and so the resulting poor quality would eventually force patrons to seek out a licensed version. This is not the case for digital content. A recorded digital song or video program may be reproduced an unlimited number of times without any deterioration in the quality of content. As a result, there has been a very active effort by the content owners, the content providers and the organizations that represent these entities to prevent the unauthorized copying of this media.

The content owners, however, are aware of the potential market for selling select digital content directly to the consumer. Content owners have always strived to find new ways of promoting their media to possible consumers. In the case of audio programs like popular songs, increased radio airplay may result in more notoriety for a particular song, and hence, more album sales. This is true for digital media as well. Online services have profited by contracting with certain music providers to offer a wide array of digital multimedia content available for a modest fee. These content providers typically allow a subscriber to search for individual digital versions of songs that may be obtained for download to a computer, personal media player, etc.

While these services have been embraced by consumers, there are currently some drawbacks to the process. A consumer must remember information identifying the content for which they are searching before engaging the service. The searching and obtaining of desired content can be a repetitive step process, sometimes requiring a user to search more than one content provider in order to find the desired program. Further, if the information is destined for a mobile device, in most cases the user must first download the information onto a desktop or laptop computer before transfer. The sum of these requirements form a multi-step, multi-device, and possibly a multi-communication medium process that can prove to be cumbersome if a variety of content is desired.

Therefore, what is needed is a system that, at the push of a button, can identify a currently playing program from a wireless broadcast for automatic downloading to a wireless communication device. The system should record identification information for the desired program to communicate to a source for the digital content, verify user identity and/or device identity, notify a user of any required agreements or fees for the use of the content, and deliver the content to a wireless communication device with any licensing or security needed to lawfully enjoy the content. In this way, a user need not remember the program-related information often required for a cumbersome manual search to be undertaken at a later time. A simple button push delivers the content to the user quickly and automatically.

SUMMARY OF INVENTION

The present invention includes at least a system and method for facilitating the selection and downloading of a digital multimedia program based on broadcast information. A single keystroke may trigger a series of events that result in an authorized copy of the desired digital media being saved on a user device. The copy of the digital media is properly licensed so that the user may enjoy listening to this media with minimal restrictions.

In at least one embodiment of the present invention, a wireless digital content provider broadcasts multimedia content that is received by a wireless communication device. The receiving device may show information pertaining to the media that is currently being played (e.g., song name and artist). If the user desires to have a copy of this song, a single keystroke may indicate to the device to obtain the particular song.

The WCD then may record information which is used to monitor the broadcast transmission in order to determine when media matching the identification information will be broadcast. When a match is found, a copy of the media is stored in encrypted format in the memory of the WCD. This monitoring/recording may occur when the broadcast receiving applications are active (e.g., user is listening/viewing broadcast content), or in a silent mode when the WCD is engaged in other activities. Alternatively, the WCD may use the recorded information to request a copy of the desired content from a content provider.

The wireless communication device may then communicate via wireless messaging with one or both of the broadcast content provider or a digital rights manager (DRM) in order to purchase usage rights for the downloaded media. This transaction may include the DRM verifying the identification of the requestor to determine if a subscription or account exists. If provisions exist for the client to obtain the media, information is returned to the client including decryption or licensing information that will allow the WCD to decrypt the stored content for enjoyment by the user.

Other embodiments of the present invention are also disclosed wherein the above transaction occurs in a different order or through alternate means. The order of the steps may be rearranged, the steps may be altered, or additional steps may be added, depending on the characteristics of the specific application.

DESCRIPTION OF DRAWINGS

The invention will be further understood from the following detailed description of a preferred embodiment, taken in conjunction with appended drawings, in which:

FIG. 5 discloses an exemplary application of a digital media distribution system in accordance with at least one embodiment of the present invention.

FIG. 6 discloses a second exemplary application of a digital media distribution system in accordance with at least one embodiment of the present invention.

FIG. 7 discloses a third exemplary application of a digital media distribution system in accordance with at least one embodiment of the present invention.

DESCRIPTION OF PREFERRED EMBODIMENT

While the invention has been described in preferred embodiments, various changes can be made therein without departing from the spirit and scope of the invention, as described in the appended claims.

The terms "program," "media" and "content" are used interchangeably in the following disclosure to represent various digital audio and/or video presentations that may be obtained using the present invention. Examples of these items are not limited to music, videos, movies, television shows, news and sports coverage, commercials, instructional videos, etc.

I. Wireless Media Broadcasting

The present invention operates in conjunction with a wireless broadcast system. The broadcast system may be based on traditional analog technologies (such as standard FM radio) or on digital broadcast media. A multitude of different systems are evolving in order to facilitate the wireless distribution of digital media. An example of one of these systems usable with at least one embodiment of the present invention, Digital Audio Broadcasting (DAB) using the Eureka 147 standard, is disclosed in FIG. 1.

Digital Audio Broadcast or DAB is a standard for digital radio broadcast developed by EUREKA as a research project for the European Union. DAB uses the Eureka 147 protocol based on orthogonal frequency division modulation (OFDM) for transmitting digital data over a typically noisy radio channel. DAB broadcasts use the MP2 audio coding technique, a close relative of the popular MP3 format, which was also created as part of the EU147 project. DAB is broadcast on terrestrial networks (e.g., via a transmission tower), and may be received using solely a tiny non-directional stub antenna. The DAB system allows for the reception of audio transmissions with CD-like quality, even in a car, without any annoying interference and signal distortion typically seen in standard FM radio transmissions.

Figure 1:
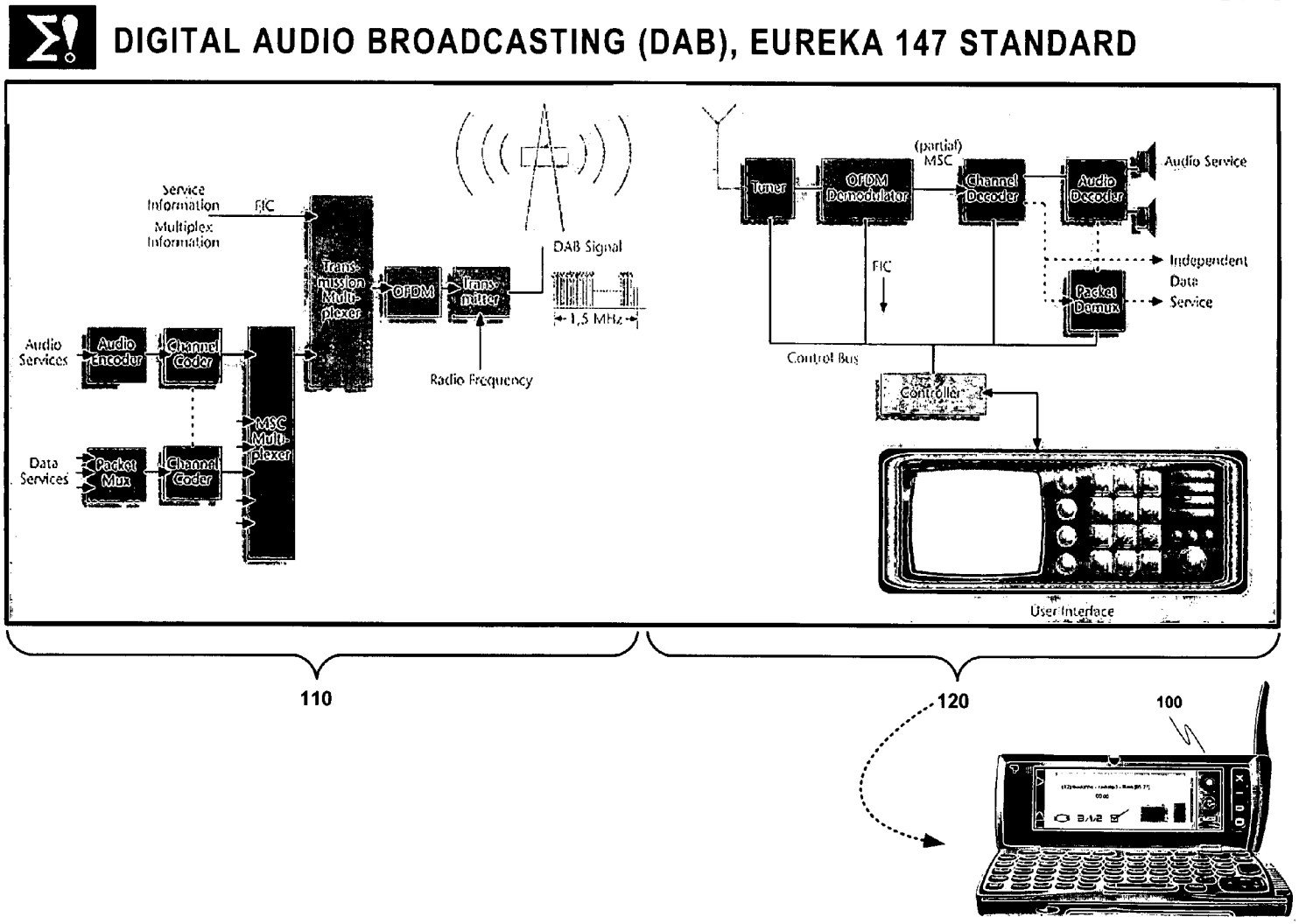
FIG. 1 discloses an example of a digital broadcast system usable with at least one embodiment of the present invention.

FIG. 1. discloses an exemplary transmission system 110 and receiving system 120. The DAB receiver device may be integrated into, or emulated by, another device such as WCD 100 also shown in FIG. 1. Transmission system 110 encodes and then combines multiple channels of media source information by multiplexing into them a single stream, and then multiplexes this combined information with service related information. DAB transmitter 110 then employs OFDM to transmit the digital multimedia information in a bandwidth-efficient and interference-resistant format to receiver system 120. Receiver system 120 then demodulates and decodes the OFDM signal to form media services, such as a left and right audio channel for stereo sound reproduction, data services and Program Associated Data (PAD) information.

PAD information is embedded in the audio bit stream, for data transmitted together with the audio program (e.g. lyrics). The amount of PAD is adjustable (min. 667 bit/s), at the expense of the capacity for the coded audio signal within the chosen audio bit-rate. Each audio program contains program associated data (PAD) with a variable capacity (minimum 667 bit/s, up to 65 kbit/s), which is used to convey information together with the sound program. The PAD Channel is incorporated at the end of the DAB/ISO audio frame. Typical examples of PAD applications are dynamic range control information, a dynamic label to display program titles or lyrics, speech/music indication and text with graphic features.

As stated above, DAB is just one example of a wireless broadcast system usable with the present invention. Other digital broadcast systems such as DVB-H are also included, as well as standard FM broadcast systems wherein information on current and future programming may be available via the Radio Data System (RDS, also known as "Smart Radio") or via the Visual Radio service. Overall, the present system may be employed in any broadcast transmission system wherein information regarding current and/or future programming is provided in addition to the broadcast content.

II. Wireless Communication Device

The present invention may be implemented using a variety of wireless communication equipment. The broadcast receiver may be a device dedicated to receiving, recording and playing back digital media, or may be a device that includes these features among a variety of other functions. Therefore, it is important to understand the communication tools available to user 110 before exploring the present invention. For example, in the case of a cellular telephone or other handheld wireless communication device, the integrated data handling capabilities of the device play an important role in facilitating transactions between the transmitting and receiving devices.

Figure 2:
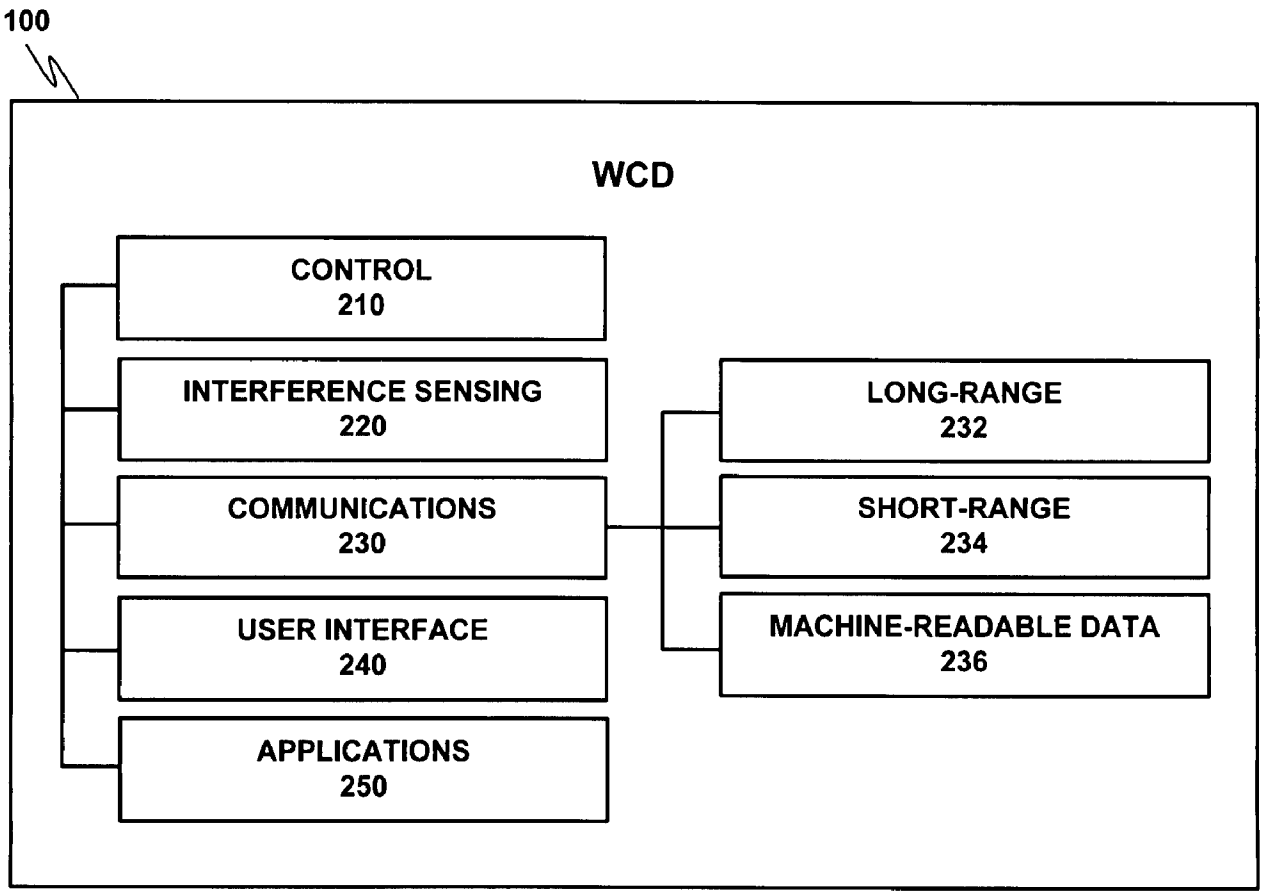
FIG. 2 discloses a modular description of an exemplary wireless communication device usable with at least one embodiment of the present invention.

FIG. 2 discloses an exemplary modular layout for a wireless communication device usable with at least one embodiment of the present invention. WCD 100 is broken down into modules representing the functional aspects of the device. These functions may be performed by the various combinations of software and/or hardware components discussed below.

Control module 210 regulates the operation of the device. Inputs may be received from various other modules included within WCD 100. For example, interference sensing module 220 may use various techniques known in the art to sense sources of environmental interference within the effective transmission range of the wireless communication device. Control module 210 interprets these data inputs, and in response, may issue control commands to the other modules in WCD 100.

Communications module 230 incorporates all of the communications aspects of WCD 100. As shown in FIG. 2, communications module 230 may include, for example, long-range communications module 232, short-range communications module 234 and machine-readable data module 236. Communications module 230 utilizes at least these sub-modules to receive a multitude of different types of communication from both local and long distance sources, and to transmit data to recipient devices within the broadcast range of WCD 100. Communications module 230 may be triggered by control module 210, or by control resources local to the module responding to sensed messages, environmental influences and/or other devices in proximity to WCD 100.

User interface module 240 includes visual, audible and tactile elements which allow the user 110 to receive data from, and enter data into, the device. The data entered by user 110 may be interpreted by control module 210 to affect the behavior of WCD 100. User-inputted data may also be transmitted by communications module 230 to other devices within effective transmission range. Other devices in transmission range may also send information to WCD 100 via communications module 230, and control module 210 may cause this information to be transferred to user interface module 240 for presentment to the user.

Applications module 250 incorporates all other hardware and/or software applications on WCD 100. These applications may include sensors, interfaces, utilities, interpreters, data applications, etc., and may be invoked by control module 210 to read information provided by the various modules and in turn supply information to requesting modules in WCD 100.

Figure 3:
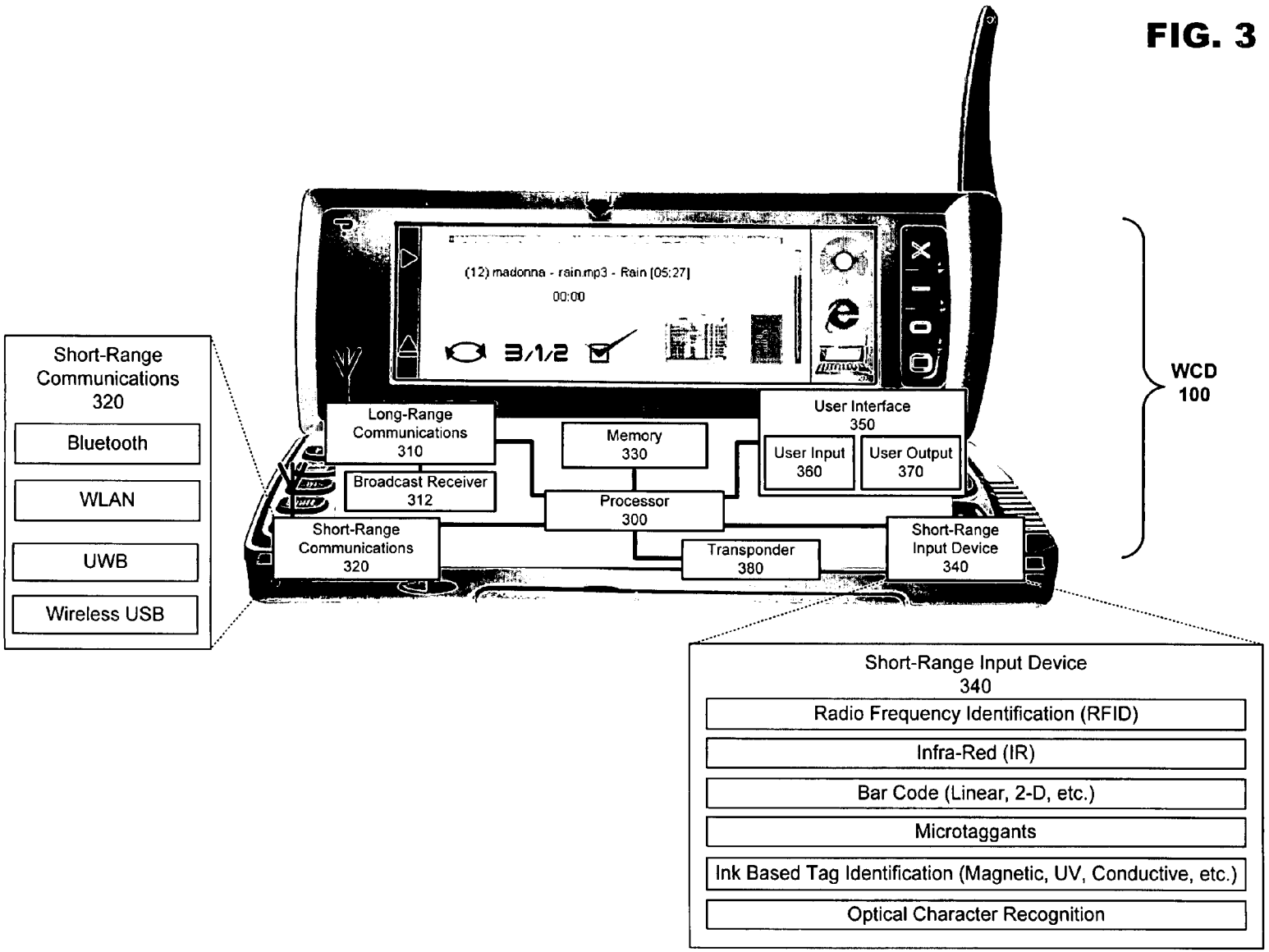
FIG. 3 discloses an exemplary structural description of the wireless communication device previously described in FIG. 2.

FIG. 3 discloses an exemplary structural layout of WCD 100 according to an embodiment of the present invention that may be used to implement the functionality of the modular system previously described in FIG. 2. Processor 300 controls overall device operation. As shown in FIG. 3, processor 300 is coupled to communications sections 310, 320 and 340. Processor 300 may be implemented with one or more microprocessors that are each capable of executing software instructions stored in memory 330.

Memory 330 may include random access memory (RAM), read only memory (ROM), and/or flash memory, and stores information in the form of data and software components (also referred to herein as modules). The data stored by memory 330 may be associated with particular software components. In addition, this data may be associated with databases, such as a bookmark database or a business database for scheduling, email, etc.

The software components stored by memory 330 include instructions that can be executed by processor 300. Various types of software components may be stored in memory 330. For instance, memory 330 may store software components that control the operation of communication sections 310, 320 and 340. Memory 330 may also store software components including a firewall, a service guide manager, a bookmark database, user interface manager, and any communications utilities modules required to support WCD 100.

Long-range communications 310 performs functions related to the exchange of information over large geographic areas (such as cellular networks) via an antenna. These communication methods include technologies from the previously described 1G to 3G and soon fourth generation streaming video transmission. In addition to basic voice communications (e.g., via GSM), long-range communications 310 may operate to establish data communications sessions, such as General Packet Radio Service (GPRS) sessions and/or Universal Mobile Telecommunications System (UMTS) sessions. Also, long-range communications 310 may operate to transmit and receive messages, such as short messaging service (SMS) messages and/or multimedia messaging service (MMS) messages.

As a subset of long-range communications 310, or alternatively operating as an independent module separately connected to processor 300 (not pictured), broadcast receiver 312 allows WCD 100 to receive wireless digital broadcast content via mediums such as Analog Radio, DAB, DVB-H, etc. These transmissions may be encoded so that only certain designated receiving devices may access the broadcast content, and may contain text, audio or video information. In at least one example, WCD 100 may receive these broadcasts and use information contained within the broadcast signal to determine if the device is permitted to view the received content.

Short-range communications 320 is responsible for functions involving the exchange of information across short-range wireless networks. As described above and depicted in FIG. 3, examples of such short-range communications 320 are not limited to Bluetooth™, WLAN, UWB and Wireless USB connections. Accordingly, short-range communications 320 performs functions related to the establishment of short-range connections, as well as processing related to the transmission and reception of information via such connections.

Short-range input device 340, also depicted in FIG. 3, may provide functionality related to the short-range scanning of machine-readable data. For example, processor 300 may control short-range input device 340 to generate RF signals for activating an RFID transponder, and may in turn control the reception of signals from an RFID transponder. Other short-range scanning methods for reading machine-readable data that may be supported by the short-range input device 340 are not limited to IR communications, linear and 2-D (e.g., QR) bar code readers (including processes related to interpreting UPC labels), and optical character recognition devices for reading magnetic, UV, conductive or other types of coded data that may be provided in a tag using suitable ink. In order for the short-range input device 340 to scan the aforementioned types of machine-readable data, the input device may include optical detectors, magnetic detectors, CCDs or other sensors known in the art for interpreting machine-readable information.

As further shown in FIG. 3, user interface 350 is also coupled to processor 300. User interface 350 facilitates the exchange of information with a user. FIG. 3 shows that user interface 350 includes a user input 360 and a user output 370. User input 360 may include one or more components that allow a user to input information. Examples of such components include keypads, touch screens, and microphones. User output 370 allows a user to receive information from the device. Thus, user output portion 370 may include various components, such as a display, light emitting diodes (LED), tactile emitters and one or more audio speakers. Exemplary displays include liquid crystal displays (LCDs), and other video displays.

WCD 100 may also include one or more transponders 380. This is essentially a passive device which may be programmed by processor 300 with information to be delivered in response to a scan from an outside source. For example, an RFID scanner mounted in a entryway may continuously emit radio frequency waves. When a person with a device containing transponder 380 walks through the door, the transponder is energized and may respond with information identifying the device, the person, etc.

Hardware corresponding to communications sections 310, 312, 320 and 340 provide for the transmission and reception of signals. Accordingly, these portions may include components (e.g., electronics) that perform functions, such as modulation, demodulation, amplification, and filtering. These portions may be locally controlled, or controlled by processor 300 in accordance with software communications components stored in memory 330.

The elements shown in FIG. 3 may be constituted and coupled according to various techniques in order to produce the functionality described in FIG. 2. One such technique involves coupling separate hardware components corresponding to processor 300, communications sections 310, 312 and 320, memory 330, short-range input device 340, user interface 350, transponder 380, etc. through one or more bus interfaces. Alternatively, any and/or all of the individual components may be replaced by an integrated circuit in the form of a programmable logic device, gate array, ASIC, multi-chip module, etc. programmed to replicate the functions of the stand-alone devices. In addition, each of these components is coupled to a power source, such as a removable and/or rechargeable battery (not shown).

The user interface 350 may interact with a communications utilities software component, also contained in memory 330, which provides for the establishment of service sessions using long-range communications 310 and/or short-range communications 320. The communications utilities component may include various routines that allow the reception of services from remote devices according to mediums such as the Wireless Application Medium (WAP), Hypertext Markup Language (HTML) variants like Compact HTML (CHTML), etc.

When engaging in WAP communications with a remote server, the device functions as a WAP client. To provide this functionality, the software components may include WAP client software components, such as a Wireless Markup Language (WML) Browser, a WMLScript engine, a Push Subsystem, and a Wireless Medium Stack.

Applications (not shown) may interact with the WAP client software to provide a variety of communications services. Examples of such communications services include the reception of Internet-based content, such as headline news, exchange rates, sports results, stock quotes, weather forecasts, multilingual phrase dictionaries, shopping and dining information, local transit (e.g., bus, train, and/or subway) schedules, personal online calendars, and online travel and banking services.

The WAP-enabled device may access small files called decks which each include smaller pages called cards. Cards are small enough to fit into a small display area that is referred to herein as a microbrowser. The small size of the microbrowser and the small file sizes are suitable for accommodating low memory devices and low-bandwidth communications constraints imposed by wireless links.

Cards are written in the Wireless Markup Language (WML), which is specifically devised for small screens and one-hand navigation without a keyboard. WML is scaleable so that it is compatible with a wide range of displays that covers two-line text displays, as well as large LCD screens found on devices, such as smart phones, PDAs, and personal communicators. WML cards may include programs written in WMLScript, which is similar to JavaScript. However, through the elimination of several unnecessary functions found in these other scripting languages, WMLScript reduces memory and processing demands.

CHTML is a subset of the standard HTML command set adapted for use with small computing devices (e.g., mobile communicator, PDA, etc.). This language allows portable or handheld devices interact more freely on the Internet. CHTML takes into consideration the power, processing, memory and display limitations of small computing devices by stripping down standard HTML to a streamlined version suitable for these constraints. For example, many of the more advanced image maps, backgrounds, fonts, frames, and support for JPEG images have been eliminated. Further, scrolling is not supported because it is assumed that CHTML displays will fit within the screen of a portable device. CHTML has also been designed to operated without two dimensional cursor movement. Instead, it may be manipulated with only four buttons, which facilitates its implementation over a larger category of small computing devices.

III. Transmission of Program-related Information

Figure 4:
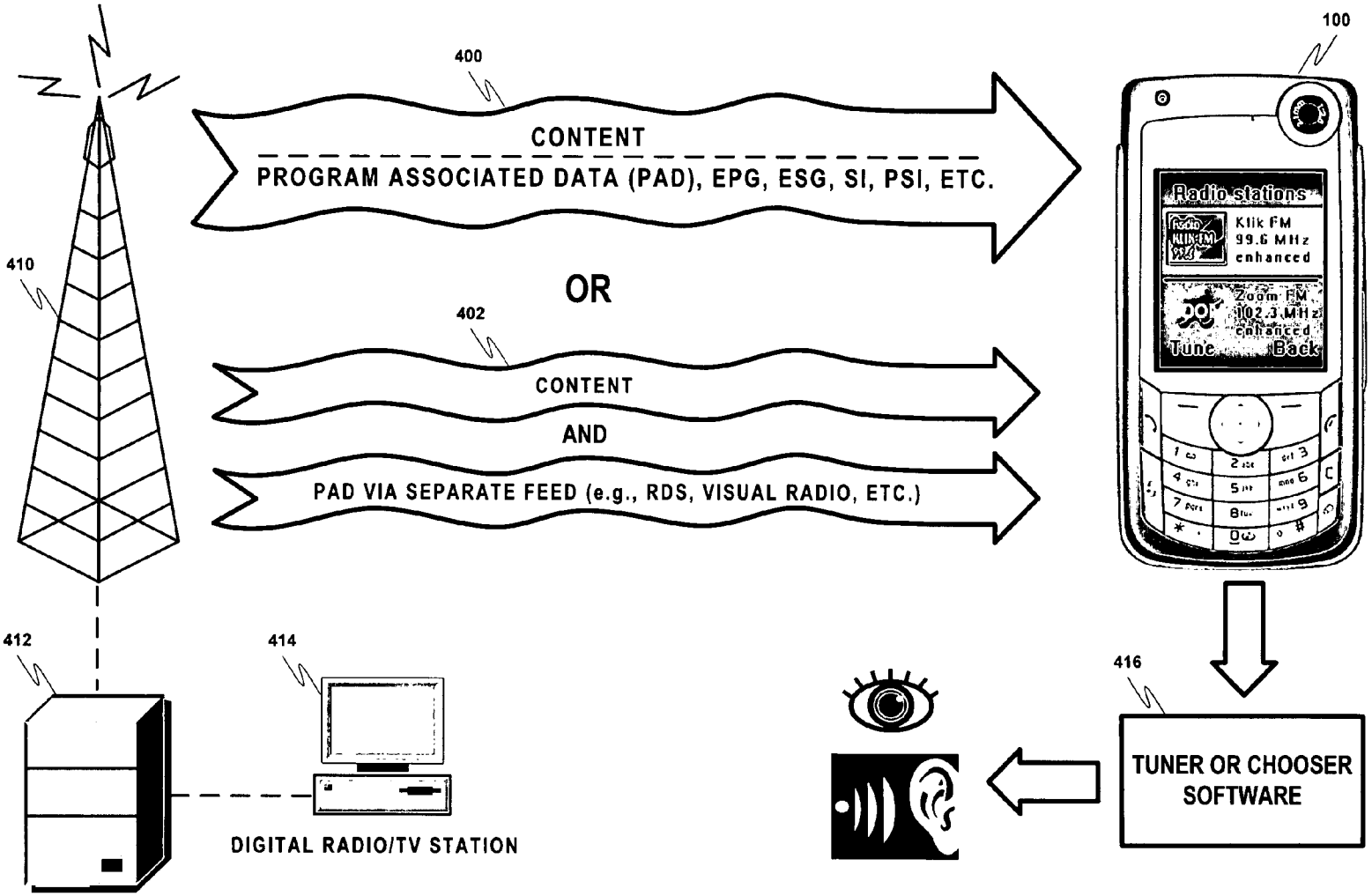
FIG. 4 discloses an exemplary diagram disclosing the transmission of broadcast information to a wireless communication device in accordance with at least one embodiment of the present invention.

FIG. 4 discloses an example of a wireless broadcast that may be received by a device like WCD 100. Digital Radio/TV station 414 may broadcast a continuous schedule of audio and/or video programs for the enjoyment of the end user. Each audio and/or video data file is stored, converted and compiled, by supporting equipment 412, into a serial stream of programs for wireless broadcast via one of the previously discussed wireless transmission standards. FIG. 4 depicts broadcast transmission 400 traveling directly from transmission tower 410 to receiving WCD 100, however, certain systems may include an intermediary delivery system such as a satellite (not pictured). These systems, such as Sirius™ and XM™ satellite radio, deliver a variety of broadcast content to satellite receivers in located in cars, homes, etc.

Broadcast transmissions 400 and 402 deliver content to WCD 100. In broadcast 400, the transmission includes both the multimedia content and PAD information composed in one digital signal that is decoded into separate information streams by the receiving device. PAD information may be received in a multitude of different formats such as Electronic Program Guide (EPG) information, Electronic Service Guide (ESG) information, Service information (SI) and Program Specific Information (PSI) for DVB-based systems, etc. Tuner or chooser software resident in WCD 100 may use the PAD information to create a selector for describing the available channels and/or programs that may be experienced by a user. The tuner software may then use the PAD information received by WCD 100 to select a certain channel from which to receive multimedia programs. In listening and/or viewing programs from a designated channel, the software may also display the name of the currently tuned channel, the name of the content currently playing or to be played next, the name and the artist/creator of the content currently being played or to be played next, album or volume names, the playing duration of the content playing or to be played next, and other content related information.

The total of the broadcast information may also be received via a combination of two or more wireless mediums. Broadcast 402 shows an example of the broadcast content and related information being transmitted separately to WCD 100. This strategy may be employed in the case of analog radio communications, wherein the content signal comes via typical analog AM/FM or shortwave transmission, and additional program information is received via an RDS or Visual Radio receiver on a separate broadcast signal. The result is that an RDS radio receiver may identify the name and the artist of the current and/or next song to be displayed on the receiving device, as well as perform other smart functions like finding the same program on another channel, interrupting transmission with weather emergency announcements, etc. Visual Radio offers similar features, though the implementation may be different. In the case of Visual Radio, the content-related data may be provided via a digital medium like GPRS or another digital wireless medium. In the digital realm, PAD information like EPG, ESG, SI and PSI may also be sent via a distinct wireless medium like GPRS. This information is transmitted in parallel to the main digital program feed, and is used to communicate information related to the received content for display on WCD 100.

IV. Digital Media Distribution

An exemplary system for the wireless distribution of digital media, in accordance with at least one embodiment of the present invention, is disclosed in FIG. 5. Digital Radio/TV station provides broadcast 400 which may be received by devices such as WCD 100. While a digital radio/TV station is used in this example, as analog radio broadcast equipped with the RDS information service may also be applied as previously described.

WCD 100 includes tuner or chooser software 416. This software decodes the incoming broadcast 400 to separate content and related information streams. A user listening to the broadcast 400 may view information on current or pending content on the display of WCD 100. If the user desires to obtain a copy of the content (e.g., a song, video, offer, schedule, coupon, story, etc.) so that it may be played at the user's convenience, the user may depress "record" key (shown at 510) on WCD 100 to indicate that a licensed copy of the desired program should be requested.

Pressing record key 510 triggers WCD 100 to save the identification information related to the program to be played next. The device may then monitor the incoming broadcast PAD information to determine when the identification information of the broadcast content currently being played matches the stored identification of the desired program. When the current program matches the desired content, WCD 100 may save the incoming content in an encrypted form to memory 330. This monitoring/recording functionality may be triggered by a user when WCD 100 is being used to actively consume incoming broadcast content, however, the recording does not necessary have to occur during this active mode. WCD 100 may continue to monitor incoming broadcasts without having active any applications related to the actual playing of a broadcast, and in this passive or "silent" mode, may still record content desired by the user. A typical scenario where a passive or "silent" mode recording may be required is when the user requests a plurality of programs, wherein the downloading of these programs may need to occur over an extended period of time.

Memory 330, wherein programs may be stored, encompasses all forms of device memory both permanent and removable. These recorded programs may be stored and organized by any user-determined characteristic, including information taken from the stored PAD information. For example, a user may configure WCD 100 to store audio programs first by artist and then album, video content by title, etc.

About the same time the desired program is being stored, WCD 100 may also send a wireless message to a digital rights manager (DRM) 500. The message may be sent via any of the long-range or short-range wireless communication mediums previously described. For example, the message may be an email through a wireless connection to the Internet, long range communications through 3G technologies like GPRS or SMS, a short-range connection to a local access point via Bluetooth™, WLAN, etc. The message may contain information pertaining to the desired content, the author or owner of the desired content, a user identification, an account identification, a device identification, a wireless service provider identification and encryption information related to the stored content. Further, DRM 500 is depicted separately from digital radio/TV station 414 in FIG. 5, however, these functions may be combined in the same entity.

DRM 500 initially checks to determine whether user and/or account information usable in the purchase the desired program is recorded. To do this, the information in the electronic message may be compared to stored records to determine if the user has already set up an account. If no information exists, DRM 500 may request more information from the user. If billable information is already established, DRM 500 may then define a decryption key based on information related to one or more of the user ID, the device ID, the encryption type, the program ID, the artist/creator ID, etc. More specifically, the encryption key may be created to verify one or more of the previous variables when activated, and if the verification fails (e.g., the actual device identification does not match the expected device identification), the key will not allow the content to be decoded. The record of the transaction is stored for billing the user's account, and the decryption information is sent back to WCD 100 via a wireless message.

WCD 100 receives the wireless message including the decryption key from DRM 500. The decryption information is used to decode the encrypted stored content for use on WCD 100 through, for example, digital media player 512. Depending on the distribution strategy employed by DRM 500, the content may be decrypted initially and then may reside on WCD 100 in a unsecured form, or alternatively, the stored content may require the decryption key every time the content is used. This latter system is advantageous for the content owner because while a user may download a licensed copy of the content, it would be extremely difficult to copy the program onto other devices. Each subsequent device would also need a similar decryption key, which as previously stated, may be encoded to require the verification of certain variables related to a current user and/or device before decrypting the content.

FIG. 6 is a similar digital media distribution system to FIG. 5, except that in the example of FIG. 6 the order of some of the steps have been altered, and additional steps have been added, to better accommodate the requirements of the user. The user still indicates via record button 510 the future content to be played. However, in this case the feasibility of the transaction is first verified with DRM 500 in steps 1-8. Confirming the transaction before downloading the desired program in encrypted form prevents the needless consumption of wireless bandwidth and memory 330 in WCD 100 if the user does not have an account with DRM 510, does not want to start an account with DRM 510, does not have sufficient funds to pay for the content, etc.

After it is verified that the transaction can occur, the content may then be downloaded by matching the desired content information to the information of the content currently playing as previously described. Once the content and the decryption key have been received by WCD 100, the use of the decryption key to play the downloaded program may trigger a subsequent message to DRM 500 confirming that both the encrypted content and decryption key were received and used successfully, and as a result, the user may now be billed for the content. This final additional confirmation step allows DRM 500 to confirm that all parts of the transaction were successfully completed before billing the customer, which may prevent future requests from the customer for account credits due to incomplete or corrupt downloads.

FIG. 7 is a further example application of the present invention including an additional communication transaction with digital radio/TV station 414 in step 5(*a*). The information reported to station 414 may include the name of the desired content, information related to the creator/owner of the content, requestor identification information, etc. Station 414 may use this information for a variety of applications. For example, when the broadcast medium includes standard analog FM broadcasts including RDS, WCD 100 may, in lieu of recording a copy of the desired content directly from the broadcast signal, have a desired program request fulfilled by station 414, wherein the encrypted content may sent to the requestor via the same or an alternative medium, for example, GPRS, as an email attachment or via another wireless medium capable of transporting the encrypted file. Alternatively, a web link may be included in a return message for the user to download the desired content at their leisure. The user identification may also be stored for use in contests, for example, where a user who downloads a song is entered in a raffle to win a prize. Station 414 may further compile this information to determine future play lists, wherein content that is in higher demand will be played more often by digital radio/TV station 414. Further, compiled statistics may be used to determine any fees or royalties that are owed to the content owner for airplay of their content.

The process of execution for at least one embodiment of the present invention is shown in FIG. 8A-8D. In step 800, radio/TV station 414 broadcasts information including both program content and PAD information. A user may consume the audio and/or video programs and determine whether the content is something they want to purchase in steps 810 and 812. If the broadcast content should be downloaded, the user indicates interest by pressing a record button in step 814, which begins the process. In step 816, a wireless message is then sent to DRM 500 including information related to one or more of the desired content, user and device.

In at least one embodiment of the invention, the device may download the desired content in step 822. This process is discussed in more detail in FIG. 8B under the reference "A." When the record button is depressed in step 814, information related to the desired content is stored in memory 330 of WCD 100 (step 900). The receiving communication device may then monitor incoming programs in step 910 to determine whether the PAD information of these future programs matches the saved information form the desired content. If the incoming information does not match in step 920, then the device continues to check, if a match is made, then WCD 100 begins to download the broadcast information in encrypted form (step 930). It is important to note that, as previously stated, this process may occur in an active mode (e.g., when the user is listening or viewing the broadcast content) or in a passive or "silent" mode when WCD 100 may be engaged in performing other functions. The download completes in step 940 and the process moves to DRM 500 receiving a wireless electronic message in step 818.

As previously recited in step 816, the pressing of the record button may cause a wireless message to be sent from WCD 100 to DRM 500. The processing of this message is described in step 818, with the details of the processing shown in FIG. 8C under the reference "B." The wireless message to DRM 500 is received in step 1000. As previously discussed, DRM 500 and broadcast station 414 may be one in the same, or separate entities. DRM 500 may, in step 1010, verify whether the user indicated in the received wireless message is already known to the DRM (e.g., a previously registered user who may have already purchased media through the process of the present invention).

If the user is unknown, then in step 1030 DRM 500 may request more information from the user in order to establish an account. This information may include well-known identification and billing information such as name, address, telephone number, credit card number, etc. This information may be received in step 1060. In another example (not pictured), step 1030 may simply inquire with the user as to whether DRM 500 has permission to bill the user's service provider account (e.g., a cellular service provider) for the requested program. Step 1020 shows an alternate situation wherein the user has account information already established with DRM 500. In this case, DRM 500 may simply check to determine whether the user has the ability to purchase the desired media. In the case where an account must be "loaded" (e.g., where the user must deposit funds in the account from which purchase costs are drawn) the declining balance may be depleted. If this is the case, then in step 1050 the user may be notified via a wireless message to place more funds in the account.

Given the success of establishing a user account via either of the previously recited methods, a charge for purchasing the desired program may then be established in step 1070. The user may then receive an electronic wireless message indicating that the media that was purchased, that their account has been charged, the amount that has been charged to the account, etc. This message may be sent at the same time, or separately from, the decryption key that will now be described in step 820 of FIG. 8A, with the details of the processing shown in FIG. 8D under the reference "C."

Figure 8A:
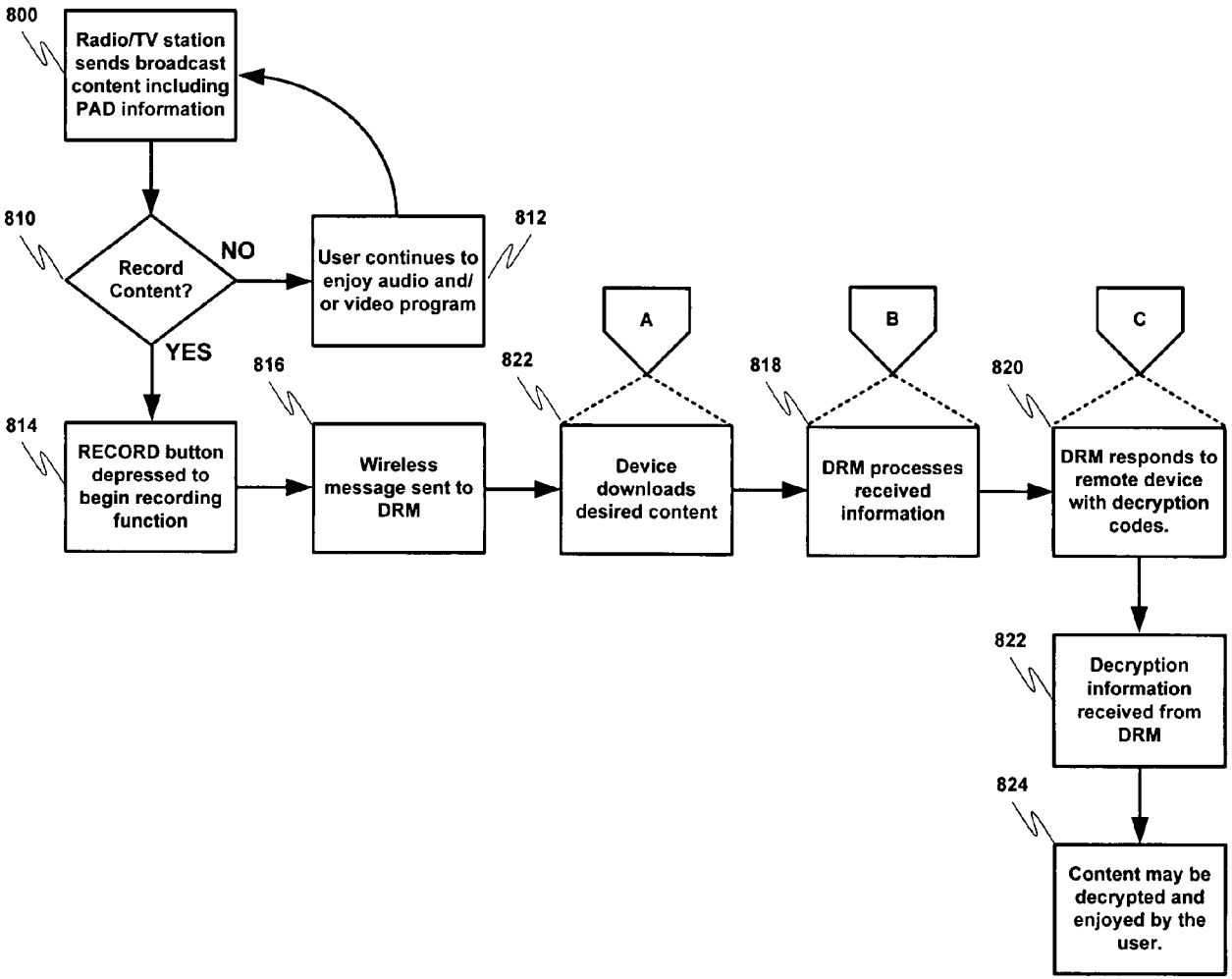
FIG. 8A discloses an exemplary flow chart describing a digital media distribution process in accordance with at least one embodiment of the present invention.
Figure 8B:
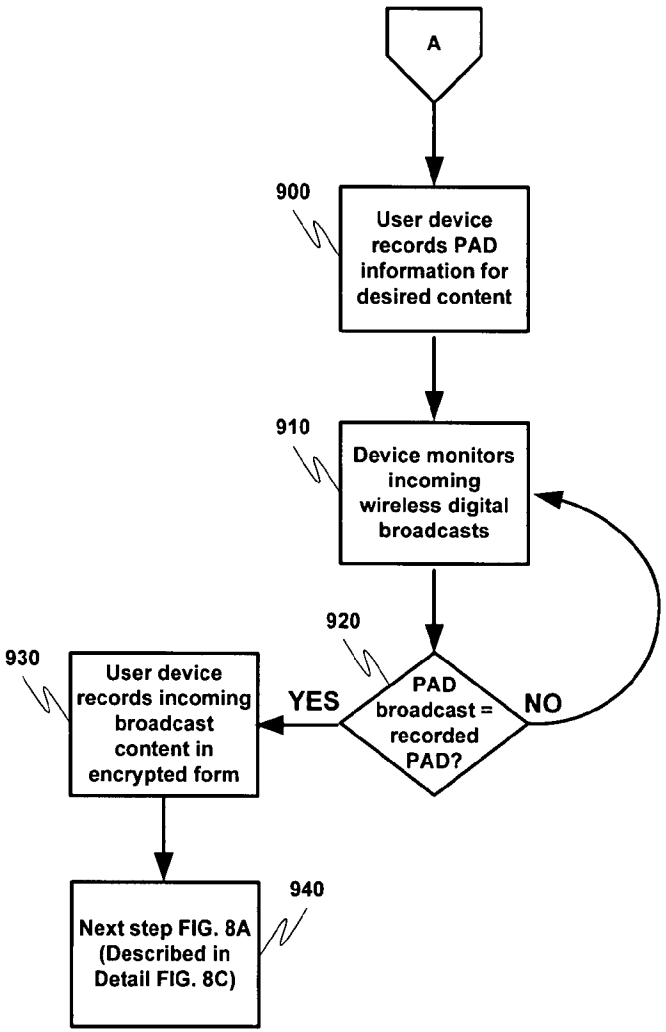
FIG. 8B discloses an exemplary flow chart describing a digital media delivery process in accordance with at least one embodiment of the present invention.
Figure 8C:
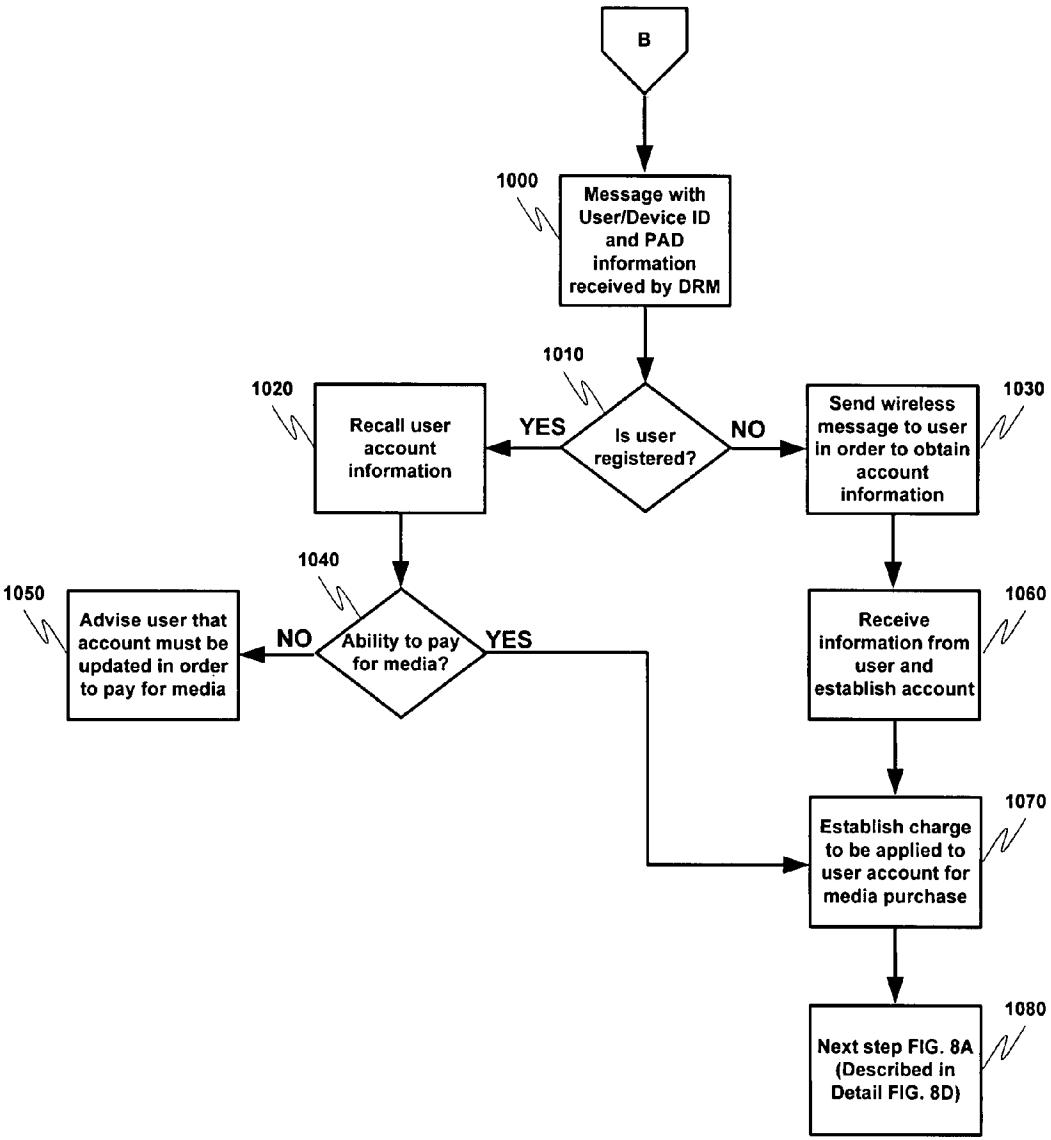
FIG. 8C discloses an exemplary flow chart describing a user verification process for a service in accordance with at least one embodiment of the present invention.
Figure 8D:
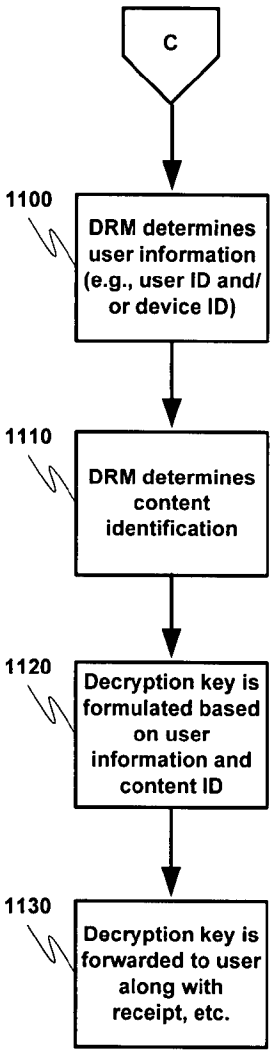
FIG. 8D discloses an exemplary flow chart describing a digital license distribution process in accordance with at least one embodiment of the present invention.

In FIG. 8D, DRM 500 determines a decryption code that is eventually delivered to WCD 100 via wireless communication. In steps 1100-1120, DRM 500 may use information including user identification, account identification, device identification, service provider identification, content identification, time, date, encryption type information, etc. to formulate a decryption key. The decryption key may then, when invoked by the user, verify current information related to one or all of the components used to compose the key. This provision may ensure that, while the user may enjoy the desired media on WCD 100 at any time, that the media may not be copied from WCD 100 to another device without purchase (e.g., without receiving a new decryption key from DRM 500), which achieves a compromise so that both the content owner and the user may be satisfied.

In step 1130 the decryption key, a receipt of the transaction and possibly license and instructional information are sent to WCD 100 via a wireless messaging transaction. This transaction may occur via any of the wireless messaging mediums previously discussed. Again referring to FIG. 8A, in steps 822 and 824, the user receives this information, and may use the decryption key to decrypt the downloaded content so that it may be viewed and/or listened to on WCD 100.

A described in FIG. 5-7, other embodiments of the present invention may slightly rearrange or alter the previously described process flow. In some cases the content may be downloaded at a later time, such as after DRM 500 confirms that the transaction may proceed. Further, an additional step may be included after the decryption key is first employed to confirm back to DRM that the encryption key was received and is functional. These steps, and others, may be altered depending on the particular application to which the present invention is applied.

The present invention is an improvement over existing systems because it streamlines the process of digital content distribution into a form easily employable by a user. A single button may automatically trigger a process that previously required multiple manual steps, and in some cases, multiple devices communicating on multiple platforms. With the present invention, all parties in the transaction are benefited. For example, the broadcast provider may learn what content is most desired by consumers, the content owner may receive compensation for the controlled provision of their content to the consumer, and the consumer is granted the ability to very simply request and receive digital content that is legally provided for their enjoyment at any time.

Accordingly, it will be apparent to persons skilled in the relevant art that various changes in forma and detail can be made therein without departing from the spirit and scope of the invention. The breadth and scope of the present invention should not be limited by any of the above-described exemplary embodiments, but should be defined only in accordance with the following claims and their equivalents.

The invention claimed is:

1. A method comprising:

determining, via at least one processor, to receive a wireless broadcast at an apparatus;

determining, via the at least one processor, to receive an indication at the apparatus, when at least one content item is selected, via a user interface, from the wireless broadcast to be downloaded;

determining, via the at least one processor, as a result of the indication, to trigger transmission of a request for the at least one content item from the apparatus, the request including at least identification information related to a requestor and the at least one content item; and determining, via the at least one processor, as a result of the indication, to download an encrypted version of the at least one content item to the apparatus to be decrypted with a decryption key, wherein the wireless broadcast includes radio data service information, visual radio information, or a combination thereof.

2. The method of claim 1, wherein the wireless broadcast also includes program associated data (PAD).

3. The method of claim 2, wherein the program associated data is related to the at least one content item.

4. The method of claim 3, further comprising determining to monitor the wireless broadcast for the at least one content item using the program associated data.

5. The method of claim 1, wherein the request for the at least one content item is a message sent via a wireless communication medium.

6. The method of claim 1, wherein the apparatus is wireless communication apparatus including at least a cellular telephone, a palm-top computer and a personal digital assistant.

7. The method of claim 6, wherein the wireless communication apparatus includes at least an analog or digital radio tuner and a multimedia player.

8. The method of claim 1, further comprising:

determining to receive the decryption key; and determining to decrypt the encrypted version of the at least one content item with the decryption key.

9. The method of claim 8, wherein the decryption key is received before the encrypted version of the at least one content item is downloaded to the apparatus.

10. The method of claim 8, wherein the decryption key is received after the encrypted version of the at least one content item is downloaded to the apparatus.

11. The method of claim 1, wherein the decryption key is received through a wireless message.

12. The method of claim 1, further comprising:

determining, via the at least one processor, as a result of the indication, to pay for the encrypted version of the at least one content item, wherein the decryption key is received after the encrypted version of the at least one content item is paid for.

13. A method comprising:

determining, via at least one processor, to receive a wireless broadcast at an apparatus;

determining, via the at least one processor, to receive an indication at the apparatus, when at least one content item is selected, via a user interface, from the wireless broadcast to be downloaded;

determining, via the at least one processor, as a result of the indication, to trigger transmission of a request for the at least one content item from the apparatus, the request including at least identification information related to a requestor and the at least one content item; and determining, via the at least one processor, as a result of the indication, to download an encrypted version of the at least one content item to the apparatus to be decrypted with a decryption key, wherein the wireless broadcast includes content item name information, content item creator information, electronic program guide information, electronic service guide information, service information, visual radio information, content item specific information, or a combination thereof.

14. The method of claim 13, wherein the wireless broadcast also includes program associated data (PAD).

15. The method of claim 14, wherein the wireless broadcast includes program associated data (PAD) related to the at least one content item.

16. The method of claim 15, further comprising monitoring the wireless broadcast for the at least one content item using the program associated data.

17. The method of claim 13, wherein the request for the at least one content item is a message sent via a wireless communication medium.

18. The method of claim 13, wherein the apparatus is wireless communication apparatus including at least a cellular telephone, a palm-top computer and a personal digital assistant.

19. The method of claim 18, wherein the wireless communication apparatus includes at least an analog or digital radio tuner and a multimedia player.

20. The method of claim 13, further comprising:

receiving the decryption key; and determining to decrypt the encrypted version of the at least one content item with the decryption key.

21. The method of claim 20, wherein the decryption key is received before the encrypted version of the at least one content item is downloaded to the apparatus.

22. The method of claim 20, wherein the decryption key is received after the encrypted version of the at least one content item is downloaded to the apparatus.

23. An apparatus comprising:

at least one processor; and at least one memory including computer program code for one or more programs, the at least one memory and the computer program code configured to, with the at least one processor, cause the apparatus to perform at least the following, receive an indication, when at least one content item is selected from a wireless broadcast to be downloaded;

determine, as a result of the indication, to trigger transmission of a request for the at least one content item from the apparatus, the request including at least identification information related to a requestor and the at least one content item; and determine, as a result of the indication, to download an encrypted version of the at least one content item to the apparatus to be decrypted with a decryption key, wherein the wireless broadcast includes radio data service information, visual radio information, or a combination thereof.

24. The apparatus of claim 23, wherein the wireless broadcast also includes program associated data (PAD).

25. The apparatus of claim 24, wherein the program associated data is related to the at least one content item.

26. The apparatus of claim 25, wherein the apparatus is further caused to monitor the wireless broadcast for the at least one content item using the program associated data.

27. The apparatus of claim 23, wherein the request for the at least one content item is a message sent via a wireless communication medium.

28. The apparatus of claim 23, wherein the apparatus is wireless communication apparatus including at least a cellular telephone, a palm-top computer and a personal digital assistant.

29. The apparatus of claim 25, further including at least an analog or digital radio tuner and a multimedia player.

30. The apparatus of claim 23, wherein the apparatus is further caused to:

receive the decryption key; and determine to decrypt the encrypted version of the at least one content item with the decryption key.

31. The apparatus of claim 30, wherein the decryption key is received before the encrypted version of the at least one content item is downloaded to the apparatus.

32. The apparatus of claim 30, wherein the decryption key is received after the encrypted version of the at least one content item is downloaded to the apparatus.

33. An apparatus comprising:

at least one processor; and at least one memory including computer program code for one or more programs, the at least one memory and the computer program code configured to, with the at least one processor, cause the apparatus to perform at least the following, receive a wireless broadcast;

receive an indication when at least one content item is selected from the wireless broadcast to be downloaded;

determine, as a result of the indication, to trigger transmission of a request for the at least one content item from the apparatus, the request including at least identification information related to a requestor and the at least one content item; and determine, as a result of the indication, to download an encrypted version of the at least one content item to the apparatus to be decrypted with a decryption key, wherein the wireless broadcast includes content item name information, content item creator information, electronic program guide information, electronic service guide information, service information, visual radio information, content item specific information, or a combination thereof.

34. The apparatus of claim 33, wherein the wireless broadcast also includes program associated data (PAD).

35. The apparatus of claim 34, wherein the program associated data is related to the at least one content item.

36. The apparatus of claim 35, wherein the apparatus is further caused to monitor the wireless broadcast for the at least one content item using the program associated data.

37. The apparatus of claim 33, wherein the request for the at least one content item is a message sent via a wireless communication medium.

38. The apparatus of claim 33, wherein the apparatus is wireless communication apparatus including at least a cellular telephone, a palm-top computer and a personal digital assistant.

39. The apparatus of claim 38, further including at least an analog or digital radio tuner and a multimedia player.

40. The apparatus of claim 33, wherein the apparatus is further cased to:

receive the decryption key; and determine to decrypt the encrypted version of the at least one content item with the decryption key.

41. The apparatus of claim 40, wherein the decryption key is received before the encrypted version of the at least one content item is downloaded to the apparatus.

42. The apparatus of claim 40, wherein the decryption key is received after the encrypted version of the at least one content item is downloaded to the apparatus.

43. A non-transitory computer-readable storage medium carrying one or more sequences of one or more instructions which, when executed by one or more processors, cause an apparatus to at least perform the following steps:

determining to receive a wireless broadcast;

determining to receive an indication, when at least one content item is selected from the wireless broadcast to be downloaded;

determining, as a result of the indication, to trigger transmission of a request for the at least one content item from the apparatus, the request including at least identification information related to a requestor and the at least one content item; and determining, as a result of the indication, to download an encrypted version of the at least one content item to the apparatus to be decrypted with a decryption key, wherein the wireless broadcast includes radio data service information, visual radio information, or a combination thereof.

44. The non-transitory computer-readable storage medium of claim 43, wherein the wireless broadcast also includes program associated data (PAD).

45. The non-transitory computer-readable storage medium of claim 44, wherein the program associated data is related to the at least one content item.

46. The non-transitory computer-readable storage medium of claim 45, wherein the apparatus is caused to further perform: monitoring the wireless broadcast for the at least one content item using the program associated data.

47. The non-transitory computer-readable storage medium of claim 43, wherein the request for the at least one content item is a message sent via a wireless communication medium.

48. The non-transitory computer-readable storage medium of claim 43, wherein the apparatus is wireless communication device including at least a cellular telephone, a palm-top computer and a personal digital assistant.

49. The non-transitory computer-readable storage medium of claim 48, wherein the wireless communication device includes at least an analog or digital radio tuner and a multimedia player.

50. The non-transitory computer-readable storage medium of claim 43, wherein the apparatus is caused to further perform:

determining to receive the decryption key; and determining to decrypt the encrypted version of the at least one content item with the decryption key.

51. The non-transitory computer-readable storage medium of claim 50, wherein the decryption key is received before the encrypted version of the at least one content item is downloaded to the apparatus.

52. The non-transitory computer-readable storage medium of claim 50, wherein the decryption key is received after the encrypted version of the at least one content item is downloaded to the apparatus.

53. A non-transitory computer-readable storage medium carrying one or more sequences of one or more instructions which, when executed by one or more processors, cause an apparatus to at least perform the following steps:

determining to receive a wireless broadcast;

determining to receive an indication when at least one content item is selected from the wireless broadcast to be downloaded;

determining, as a result of the indication, to trigger transmission of a request for the at least one content item from the apparatus, the request including at least identification information related to a requestor and the at least one content item; and determining, as a result of the indication, to download an encrypted version of the at least one content item to the apparatus to be decrypted with a decryption key, wherein the wireless broadcast includes content item name information, content item creator information, electronic program guide information, electronic service guide information, service information, visual radio information, content item specific information, or a combination thereof.

54. The non-transitory computer-readable storage medium of claim 53, wherein the wireless broadcast also includes program associated data (PAD).

55. The non-transitory computer-readable storage medium of claim 54, wherein the program associated data is related to the at least one content item.

56. The non-transitory computer-readable storage medium of claim 55, wherein the apparatus is caused to further perform: determining to monitor the wireless broadcast for the at least one content item using the program associated data.

57. The non-transitory computer-readable storage medium of claim 53, wherein the request for the at least one content item is a message sent via a wireless communication medium.

58. The non-transitory computer-readable storage medium of claim 53, wherein the apparatus is wireless communication device including at least a cellular telephone, a palm-top computer and a personal digital assistant.

59. The non-transitory computer-readable storage medium of claim 58, wherein the wireless communication device includes at least an analog or digital radio tuner and a multimedia player.

60. The non-transitory computer-readable storage medium of claim 53, wherein the apparatus is caused to further perform:

determining to receive the decryption key; and determining to decrypt the encrypted version of the at least one content item with the decryption key.

61. The non-transitory computer-readable storage medium of claim 60, wherein the decryption key is received before the encrypted version of the at least one content item is downloaded to the apparatus.

62. The non-transitory computer-readable storage medium of claim 60, wherein the decryption key is received after the encrypted version of the at least one content item is downloaded to the apparatus.

* * * * *